US010027063B2

(12) United States Patent
Peng

(10) Patent No.: US 10,027,063 B2
(45) Date of Patent: Jul. 17, 2018

(54) COMPOSITE CONNECTOR

(71) Applicant: LOTES CO., LTD, Keelung (TW)

(72) Inventor: Jian Min Peng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/649,795

(22) Filed: Jul. 14, 2017

(65) Prior Publication Data

US 2018/0083391 A1 Mar. 22, 2018

(30) Foreign Application Priority Data

Sep. 22, 2016 (CN) ..... 2016 2 1069705 U

(51) Int. Cl.
*H01R 12/59* (2011.01)
*H01R 12/71* (2011.01)
(Continued)

(52) U.S. Cl.
CPC ..... *H01R 13/658* (2013.01); *H01R 12/594* (2013.01); *H01R 12/712* (2013.01); *H01R 12/775* (2013.01); *H01R 13/40* (2013.01); *H01R 13/516* (2013.01); *H01R 13/646* (2013.01); *H01R 13/6585* (2013.01); *H01R 13/6586* (2013.01); *H01R 24/64* (2013.01)

(58) Field of Classification Search
CPC .. H01R 12/594; H01R 12/712; H01R 12/775; H01R 13/40; H01R 13/516; H01R 13/646; H01R 13/658; H01R 13/6581; H01R 13/6585; H01R 13/6586
USPC ..... 439/607.09, 607.11
See application file for complete search history.

(56) References Cited

U.S. PATENT DOCUMENTS 6,939,177 B2 * 9/2005 Kato ..... H01R 27/02 439/607.01
8,808,029 B2 * 8/2014 Castillo ..... H01R 13/6585 439/607.05
(Continued)

FOREIGN PATENT DOCUMENTS

CN 101587993 A 11/2009
CN 102201628 A 9/2011
(Continued)

*Primary Examiner* — Edwin A. Leon
*Assistant Examiner* — Oscar Jimenez
(74) *Attorney, Agent, or Firm* — Locke Lord LLP; Tim Tingkang Xia, Esq.

(57) ABSTRACT

A composite connector, including: a first insulating body and a second insulating body, respectively having a first tongue plate and a second tongue plate arranged at the front ends thereof; multiple terminals respectively fixed on the first and second insulating bodies and exposed from surfaces of the first and second tongue plates; a first shielding sheet and a second shielding sheet which are integrally formed, fixed in the first and second tongue plates respectively and are positioned on one side of the terminals; and a metal shell forming a first insertion opening and a second insertion opening around the first and second tongue plates respectively. The first insertion opening is configured for insertion of a first docking connector. The second insertion opening is configured for insertion of a second docking connector. A combination of the first and second insertion openings are configured for insertion of a third docking connector.

22 Claims, 7 Drawing Sheets

(51) Int. Cl.

| | |
|---|---|
| ***H01R 12/77*** | (2011.01) |
| ***H01R 13/658*** | (2011.01) |
| ***H01R 13/6585*** | (2011.01) |
| ***H01R 13/6586*** | (2011.01) |
| ***H01R 13/40*** | (2006.01) |
| ***H01R 13/646*** | (2011.01) |
| ***H01R 13/516*** | (2006.01) |
| ***H01R 24/64*** | (2011.01) |

(56) References Cited

U.S. PATENT DOCUMENTS 8,968,031 B2 * 3/2015 Simmel ..... H01R 13/659 439/108
9,231,356 B1 * 1/2016 Ju ..... H01R 24/78
9,444,199 B2 * 9/2016 Leng ..... H01R 13/6596
9,525,244 B1 * 12/2016 Hsu ..... H01R 13/6585
9,728,885 B2 * 8/2017 Yokoyama ..... H01R 13/502
2007/0173119 A1 * 7/2007 Xiao ..... H01R 13/658 439/607.2
2010/0062653 A1 * 3/2010 Mao ..... H01R 12/712 439/660
2010/0093221 A1 * 4/2010 Mao ..... H01R 12/707 439/638
2010/0317229 A1 * 12/2010 Chen ..... H01R 27/02 439/607.23
2011/0237127 A1 * 9/2011 Ohtsuji ..... H01R 12/724 439/607.01
2012/0052726 A1 * 3/2012 Lai ..... H01R 13/6594 439/607.01
2013/0273774 A1 * 10/2013 Yang ..... H01R 43/20 439/607.58
2015/0194770 A1 * 7/2015 Little ..... H01R 13/6582 439/607.27
2016/0013599 A1 1/2016 Ueda et al.
2016/0064869 A1 * 3/2016 Yu ..... H01R 24/60 439/607.05
2016/0261056 A1 * 9/2016 Jiang ..... H01R 13/6585
2016/0372858 A1 * 12/2016 Huo ..... H01R 13/516
2017/0077652 A1 * 3/2017 Chen ..... H01R 13/405
2017/0302013 A1 * 10/2017 Ju ..... H01R 24/78
2017/0302014 A1 * 10/2017 Ju ..... H01R 24/78

FOREIGN PATENT DOCUMENTS

CN 202633554 U 12/2012
CN 103579861 A 2/2014
CN 104319576 A 1/2015
CN 204179317 U 2/2015
CN 104779489 A 7/2015
CN 204809560 U 11/2015
CN 205452594 U 8/2016
TW 201029279 A 8/2010

* cited by examiner

A–A

B–B

COMPOSITE CONNECTOR

CROSS-REFERENCE TO RELATED APPLICATION

This non-provisional application claims priority to and benefit of, under 35 U.S.C. § 119(a), Patent Application No. 201621069705.X filed in P.R. China on Sep. 22, 2016, the entire content of which is hereby incorporated by reference.

FIELD OF THE INVENTION

The present invention relates to a composite connector, and more particularly to a composite connector with a shielding function.

BACKGROUND OF THE INVENTION

A common shielding electrical connector in the industry has an insulating body, a tongue plate extends forwards from the insulating body, multiple terminals arranged in rows on the upper and lower surfaces of the tongue plate respectively, a middle shielding sheet arranged between the terminals in upper and lower rows and fixed in the tongue plate, and a metal shell framed outside the insulating body and matched with the tongue plate to form a docking space. The docking space is configured for docking with a docking electrical connector.

The foregoing shielding electrical connector has a shielding function to achieve the high frequency requirements of customers. However, along with development of social technologies, in order to meet the customer needs on transmission efficiency and functional diversity, each of the electronic products may be provided with various interfaces provided thereon, which frequently causes the customers for mistakenly plugging the connectors, and occupies certain space of the electronic products, thus being inconsistent with the trend of miniaturization development.

To meet the customer needs, a composite connector emerged in the industry, which provides two shielding electrical connectors that share a metal shell, and other structures maintain unchanged. In this case, the metal shell matches with one tongue plate to form a first insertion space, and the metal shell matches with another tongue plate to form a second insertion space. Further, the metal shell may even match with the two tongue plates to form a third insertion space, so that three types of docking connectors may be inserted. By such a design, functions are extended, transmission efficiency is improved, and the sharing of the metal shell can also save the space. However, the structures other than the metal shell are independently formed, which causes complexity of the forming process and tediousness in assembling.

Therefore, a heretofore unaddressed need to design a new composite connector exists in the art to address the aforementioned deficiencies and inadequacies.

SUMMARY OF THE INVENTION

In one aspect, the present invention is directed to a composite connector with two shielding sheets integrally formed for process simplification.

To achieve the foregoing objective, one aspect of the invention provides a combined connector, including: a first insulating body and a second insulating body arranged side by side, wherein a first tongue plate and a second tongue plate are arranged at front ends of the first insulating body and the second insulating body respectively, a fool-proof member is arranged between the first insulating body and the second insulating body, and gaps are formed between the fool-proof member and the first tongue plate and between the fool-proof member and the second tongue plate; a plurality of terminals, respectively fixedly arranged on the first insulating body and the second insulating body and exposed from surfaces of the first tongue plate and the second tongue plate; and a first shielding sheet and a second shielding sheet, fixedly arranged in the first tongue plate and the second tongue plate respectively, and are positioned on one side of the terminals, wherein the first shielding sheet and the second shielding sheet are integrally formed, and a reinforcing plate is integrally formed between the first shielding sheet and the second shielding sheet and positioned in the fool-proof member.

In certain embodiments, two sides of the reinforcing plate are exposed from two lateral surfaces of the fool-proof member respectively. In one embodiment, each of the two lateral surfaces has a middle section concaved inwards, and a front section and a rear section respectively positioned in front of and behind the middle section, and each of the two sides of the reinforcing plate projects from the middle section and is flush with the front section and the rear section of the corresponding lateral surface. In certain embodiments, the first insulating body, the second insulating body and the fool-proof member are integrally formed. In certain embodiments, the fool-proof member extends forward beyond the first tongue plate and the second tongue plate. In certain embodiments, the first shielding sheet and the second shielding sheet are embedded in the first tongue plate and the second tongue plate. In certain embodiments, the terminals are arranged on upper surfaces and lower surfaces of the first tongue plate and the second tongue plate respectively, the number of the terminals on the first tongue plate is unequal to the number of the terminals on the second tongue plate, the first shielding sheet and the second shielding sheet are positioned between the terminals in a upper row and a lower row respectively, and the terminals in each row are arranged in a central symmetry.

In certain embodiments, fastening slots are formed at the two sides of the first shielding sheet and the second shielding sheet respectively, and are exposed from the first tongue plate and the second tongue plate. In one embodiment, the first tongue plate and the second tongue plate are provided with grooves corresponding to the fastening slots, and the fastening slots and the grooves are at least partially laterally flush. In one embodiment, hollow slots are concavely formed at the two sides of the first shielding sheet and the second shielding sheet close to rear ends of the fastening slots respectively. In one embodiment, a plurality of strip connecting portions is respectively provided on at least one of the two sides of the first shielding sheet and the second shielding sheet close to rear ends of the hollow slots, and the strip connecting portions are respectively exposed from the two lateral surfaces of the first insulating body and the second insulating body.

In certain embodiments, the composite connector further includes a metal shell, wherein the metal shell forms a first insertion opening and a second insertion opening around the first tongue plate and the second tongue plate respectively, the first insertion opening is configured for insertion of a first docking connector, the second insertion opening is configured for insertion of a second docking connector, and a combination of the first insertion opening and the second insertion opening is configured for insertion of a third docking connector. In certain embodiments, the metal shell has a top wall and a bottom wall, two wrapping portions are formed corresponding to two reserved slots at a front end of the fool-proof member by bending and extending from the top wall and the bottom wall respectively, and the two wrapping portions are fixed in the two reserved slots respectively. In one embodiment, the two wrapping portions bend and extend respectively downwards and upwards from edges of the top wall and the bottom wall, and a width of each of the wrapping portions is smaller than a width of the fool-proof member.

In certain embodiments, the fool-proof member abuts against an inner wall of the metal shell upwards and downwards in a vertical direction respectively, the first insertion opening is formed by the metal shell and one of the two lateral surfaces of the fool-proof member, and the second insertion opening is formed by the metal shell and the other of the two lateral surfaces of the fool-proof member. In certain embodiments, a grounding portion is arranged on the side of each of the first shielding sheet and the second shielding sheet close to a rear end and away from the reinforcing plate, and the grounding portion protrudes and extends to contact with the inner wall of the metal shell.

In certain embodiments, a clamping portion is arranged at a rear end of the first insulating body and the second insulating body, the clamping portion forms a fixing space configured to clamp a circuit board therein, and a height of a rear end of the fixing space is lower than a height of a front end of the fixing space. In one embodiment, the clamping portion is aligned to the fool-proof member in a front-rear direction, and a width of the clamping portion is greater than a width of the fool-proof member.

Another aspect of the invention provides a composite connector, including: a first insulating body and a second insulating body, wherein a first tongue plate and a second tongue plate are arranged at front ends of the first insulating body and the second insulating body respectively; a plurality of terminals, respectively fixed on the first insulating body and the second insulating body and exposed from surfaces of the first tongue plate and the second tongue plate; a first shielding sheet and a second shielding sheet, fixed in the first tongue plate and the second tongue plate respectively, and are positioned on one side of the terminals, wherein the first shielding sheet and the second shielding sheet are integrally formed; and a metal shell, forming a first insertion opening and a second insertion opening around the first tongue plate and the second tongue plate respectively, wherein the first insertion opening is configured for insertion of a first docking connector, the second insertion opening is configured for insertion of a second docking connector, and a combination of the first insertion opening and the second insertion opening is configured for insertion of a third docking connector.

In certain embodiments, a fool-proof member is integrally formed between the first insulating body and the second insulating body, gaps are formed between the fool-proof member and the first tongue plate and between the fool-proof member and the second tongue plate, and a reinforcing plate is integrally formed between the first shielding sheet and the second shielding sheet and positioned in the fool-proof member. In one embodiment, two sides of the reinforcing plate are respectively exposed from two lateral surfaces of the fool-proof member, the first insertion opening is formed by the metal shell and one of the two sides of the reinforcing plate, and the second insertion opening is formed by the metal shell and the other of the two sides of the reinforcing plate. In one embodiment, fastening slots are formed at the two sides of the first shielding sheet and the second shielding sheet respectively, the first tongue plate and the second tongue plate are provided with grooves corresponding to the fastening slots, the fastening slots are exposed from the grooves, and the fastening slots and the grooves are at least partially laterally flush. In one embodiment, the terminals are arranged on upper surfaces and lower surfaces of the first tongue plate and the second tongue plate respectively, the number of the terminals on the first tongue plate is unequal to the number of the terminals on the second tongue plate, the first shielding sheet and the second shielding sheet are positioned between the terminals in a upper row and a lower row respectively, and the terminals in each row are arranged in a central symmetry.

Compared with the art, the composite connector according to certain embodiments of the present invention has the advantage that the two shielding sheets are integrally formed, so that a forming process and an assembling process for the shielding sheets can be simplified.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
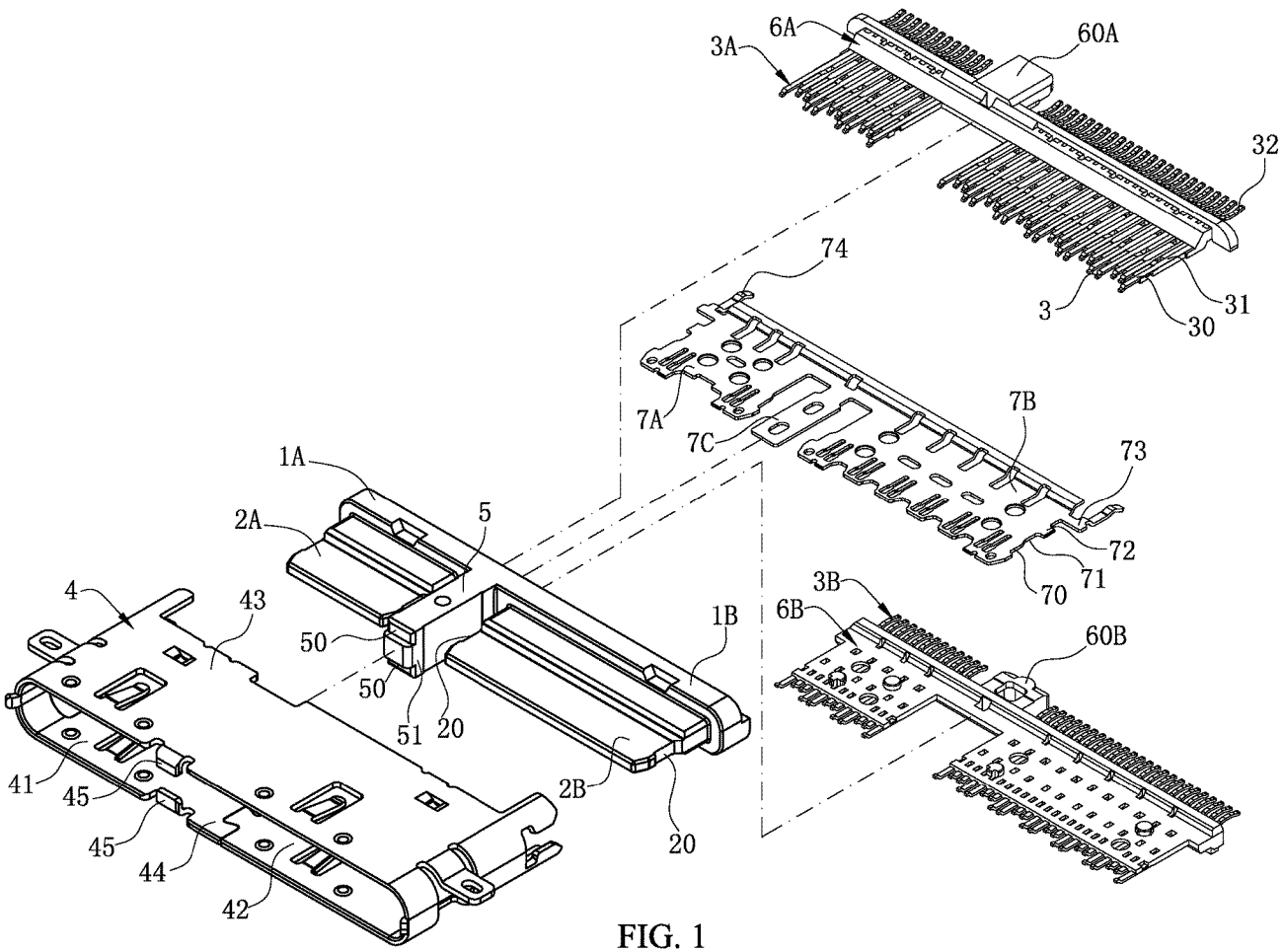
FIG. 1 is an exploded view of a composite connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to a composite connector.

Figure 4:
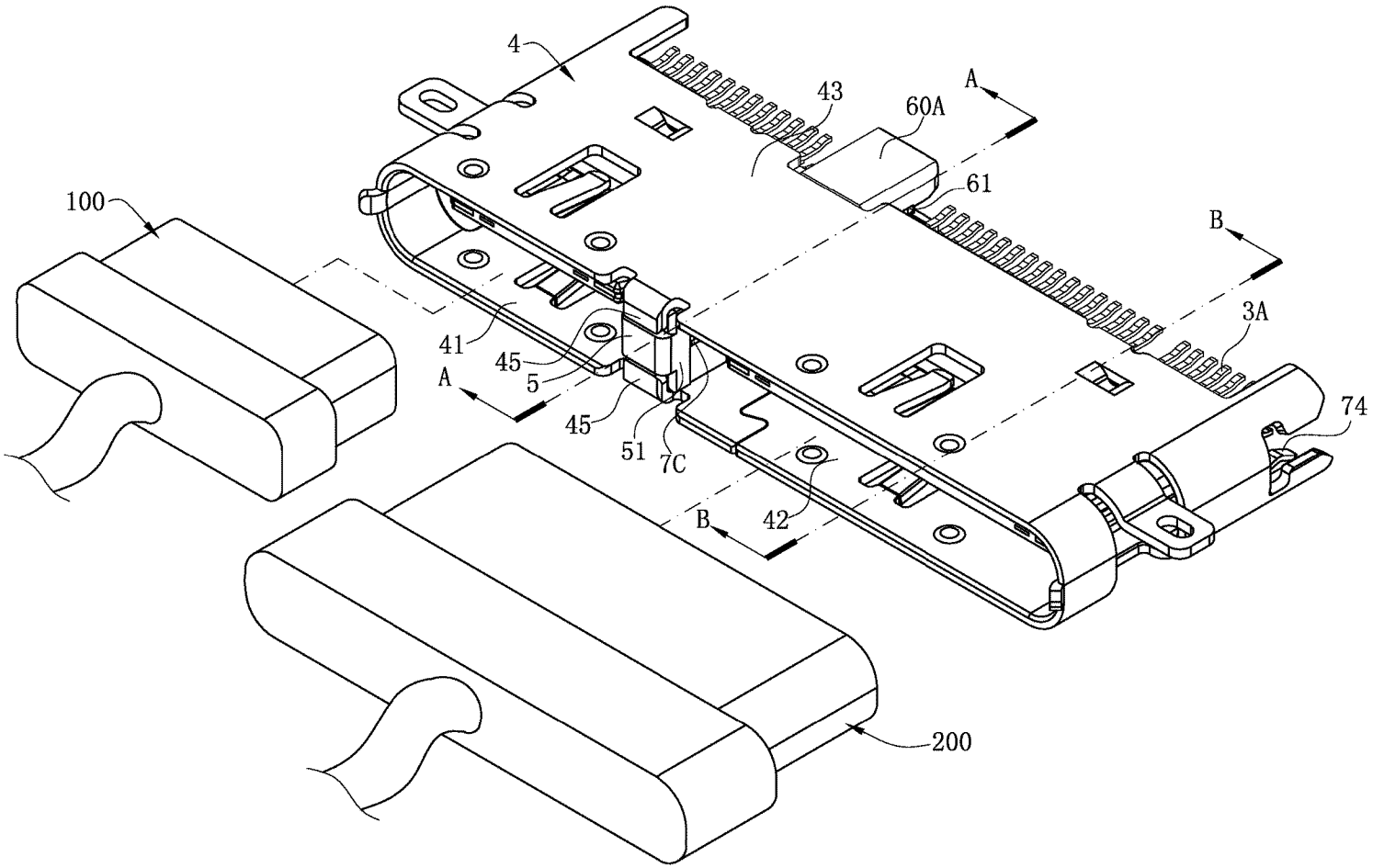
FIG. 4 is a three-dimensional exploded view of the composite connector, a first docking connector and a second docking connector according to one embodiment of the present invention.
Figure 5:
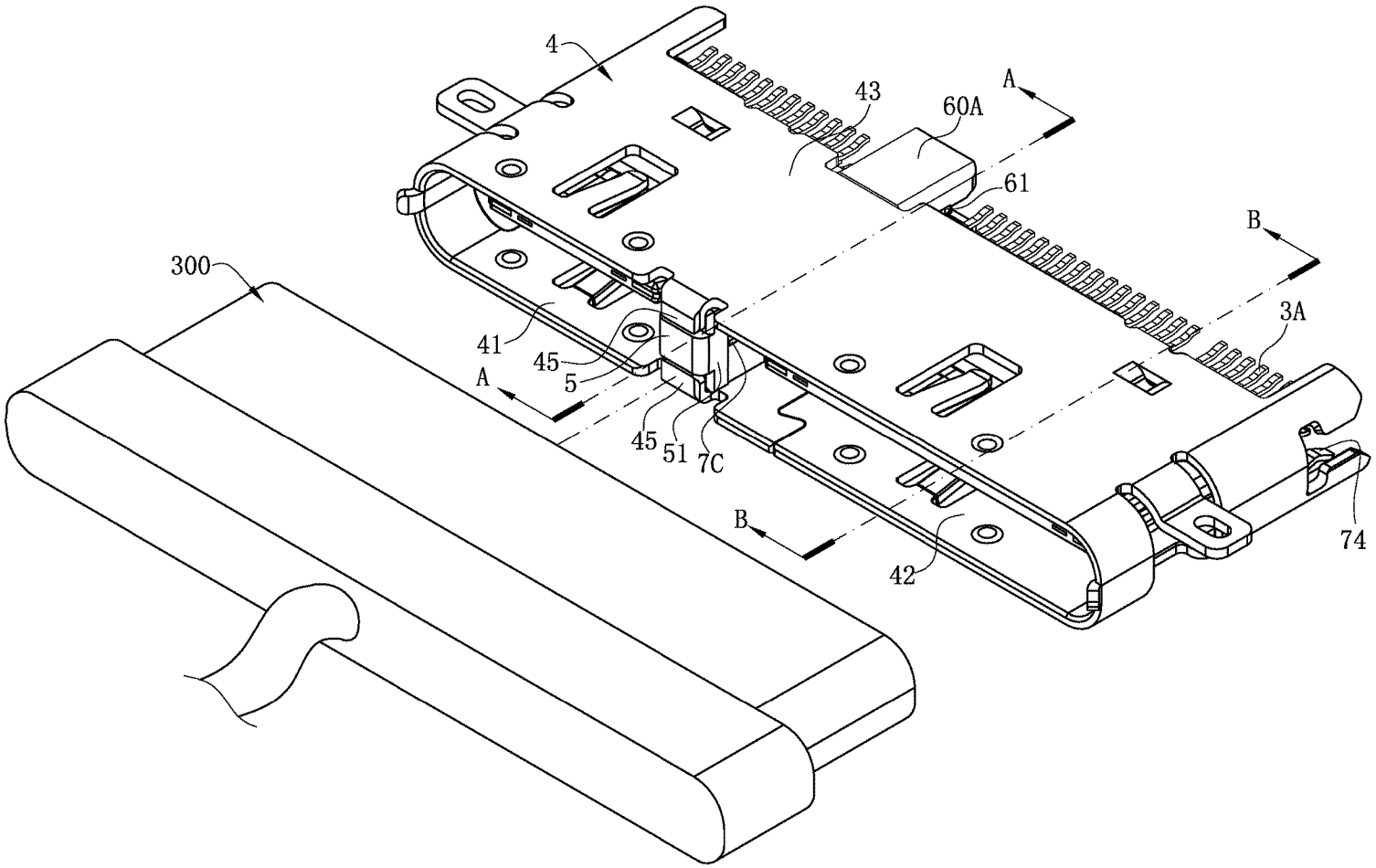
FIG. 5 is a three-dimensional exploded view of the composite connector and a third docking connector according to one embodiment of the present invention.

As shown in FIG. 1, FIG. 4 and FIG. 5, a composite connector includes a first insulating body 1A and a second insulating body 1B, which are arranged side by side, a first tongue plate 2A and a second tongue plate 2B arranged at the front ends of the first insulating body 1A and the second insulating body 1B respectively, multiple terminals 3 fixedly arranged on the first insulating body 1A and the second insulating body 1B respectively, and a metal shell 4 wrapping the first insulating body 1A and the second insulating body 1B. The external metal shell 4 forms a first insertion opening 41 and a second insertion opening 42 around the first tongue plate 2A and the second tongue plate 2B respectively. As shown in FIG. 4, the first insertion opening 41 is configured for insertion of a first docking connector 100, and the second insertion opening 42 is configured for insertion of a second docking connector 200. As shown in FIG. 5, a combination of the first insertion opening 41 and the second insertion opening 42 is configured for insertion of a third docking connector 300.

Figure 2:
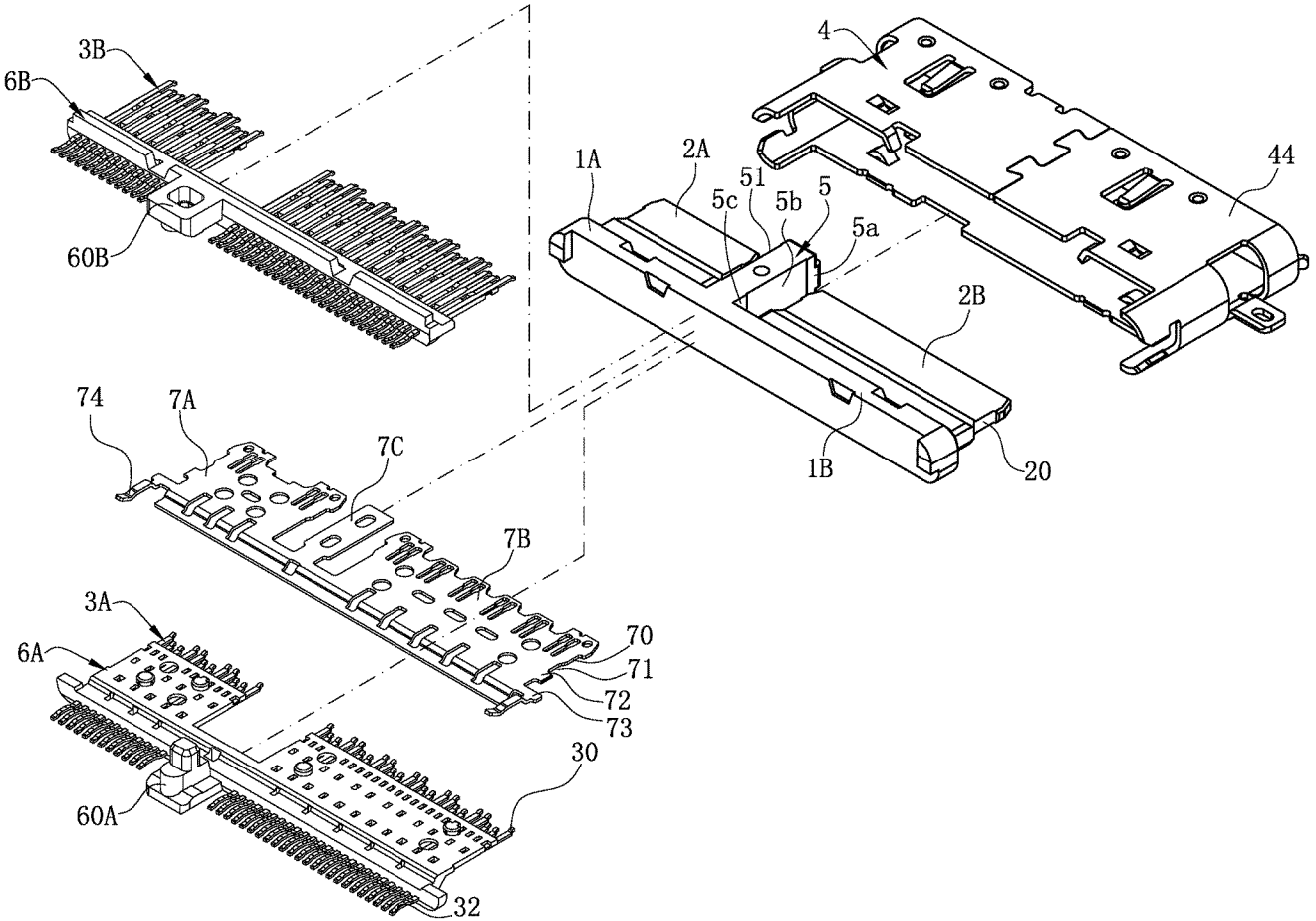
FIG. 2 is a schematic view of FIG. 1 from another angle.
Figure 3:
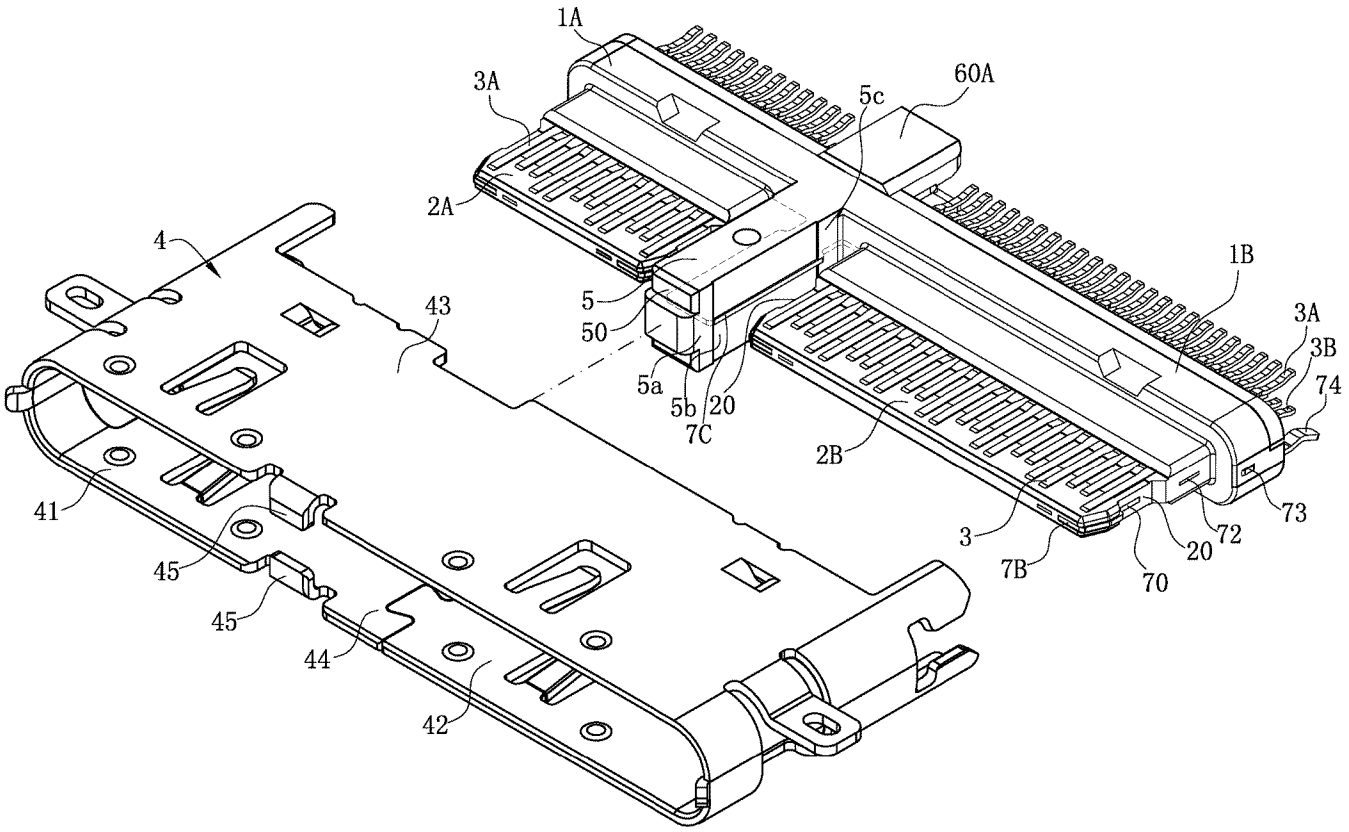
FIG. 3 is a schematic view of an unassembled metal shell according to one embodiment of the present invention.

As shown in FIG. 1 to FIG. 3, the first insulating body 1A and the second insulating body 1B are made of a plastic material. The front ends of the first insulating body 1A and the second insulating body 1B integrally extend forwards to form the first tongue plate 2A and the second tongue plate 2B respectively. The terminals 3 are at least partially exposed from the surfaces of the first tongue plate 2A and the second tongue plate 2B. A certain distance is formed between the first tongue plate 2A and the second tongue plate 2B, and the first tongue plate 2A and the second tongue plate 2B are positioned in the same horizontal plane.

A fool-proof member 5 made of the plastic material is arranged between the first insulating body 1A and the second insulating body 1B. For forming convenience and process simplification, in the embodiment, the first insulating body 1A, the second insulating body 1B and the fool-proof member 5 are integrally formed. Gaps are formed between the fool-proof member 5 and the first tongue plate 2A and between the fool-proof member 5 and the second tongue plate 2B, and the fool-proof member 5 extends forward beyond the first tongue plate 2A and the second tongue plate 2B, thus enabling the docking connectors to be guided for insertion, and preventing the first tongue plate 2A, the second tongue plate 2B and the terminals 3 positioned on the first tongue plate 2A and the second tongue plate 2B from being damaged by inserting the docking connectors. Two reserved slots 50 are concavely formed in the front end surface of the fool-proof member 5.

Figure 6:
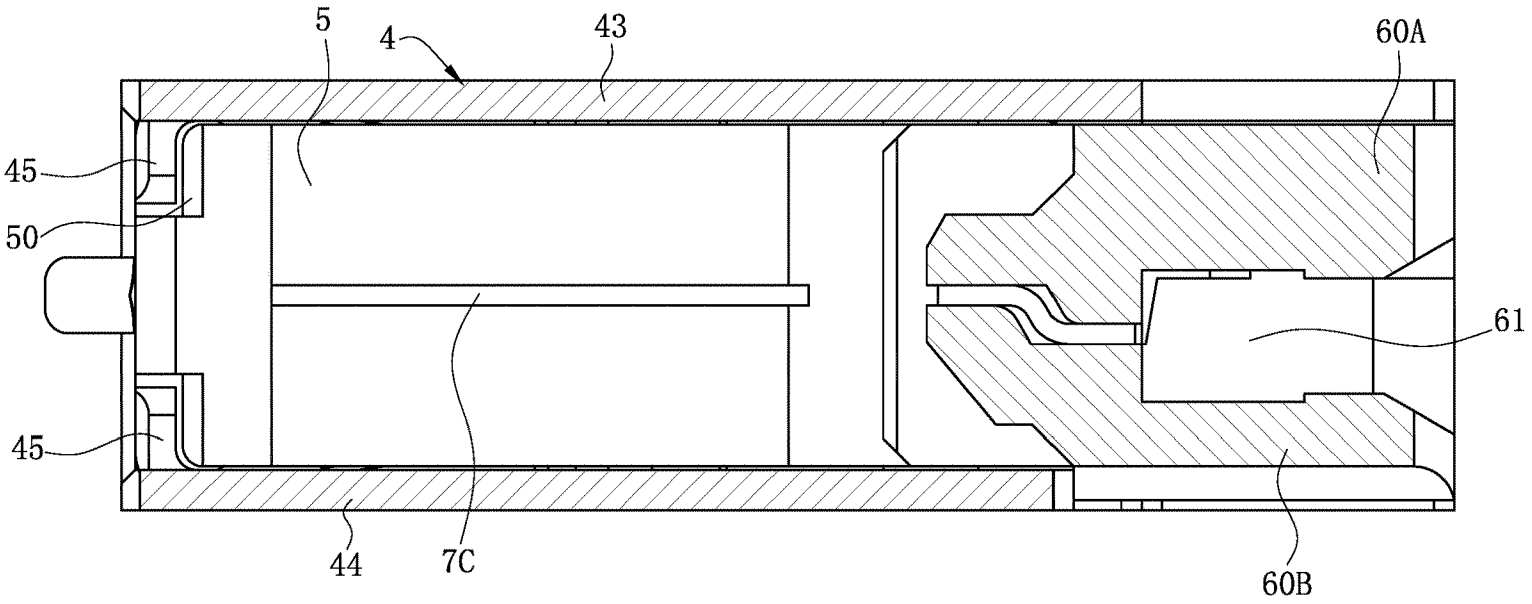
FIG. 6 is a local sectional view of the composite connector in FIG. 4 along a line A-A.

As shown in FIG. 4, FIG. 5 and FIG. 6, the fool-proof member 5 abuts against an inner wall of the metal shell 4 upwards and downwards in a vertical direction respectively. The first insertion opening 41 is formed by the metal shell 4 and one lateral surface 51 of the fool-proof member 5, and the second insertion opening 42 is formed by the metal shell 4 and the other lateral surface of the fool-proof member 5. Therefore, the insertion openings are formed by fully utilizing the structure of the fool-proof member 5, and the space and materials can be saved.

Multiple terminals 3 are arranged on the upper surfaces and the lower surfaces of both the first tongue plate 2A and the second tongue plate 2B, thereby forming the terminals 3A and 3B in a upper row and a lower row, respectively. The number of the terminals 3 on the first tongue plate 2A is unequal to the number of the terminals 3 on the second tongue plate 2B, and the terminals 3 of each row are arranged in a central symmetry.

As shown in FIG. 1 to FIG. 3, in the embodiment, the composite connector further includes an upper insulator 6A and a lower insulator 6B. The terminals 3A in the upper row are integrally inserted-molded in the upper insulator 6A to form a first module. The terminals 3B in the lower row are integrally inserted-molded in the lower insulator 6B to form a second module. The first module and the second module are assembled together, and a first shielding sheet 7A and a second shielding sheet 7B are clamped therebetween to form a third module. The periphery of the third module is integrally wrapped with a plastic material, thereby integrally forming the first insulating body 1A, the second insulating body 1B, the fool-proof member 5, the first tongue plate 2A and the second tongue plate 2B outside the third module.

Figure 7:
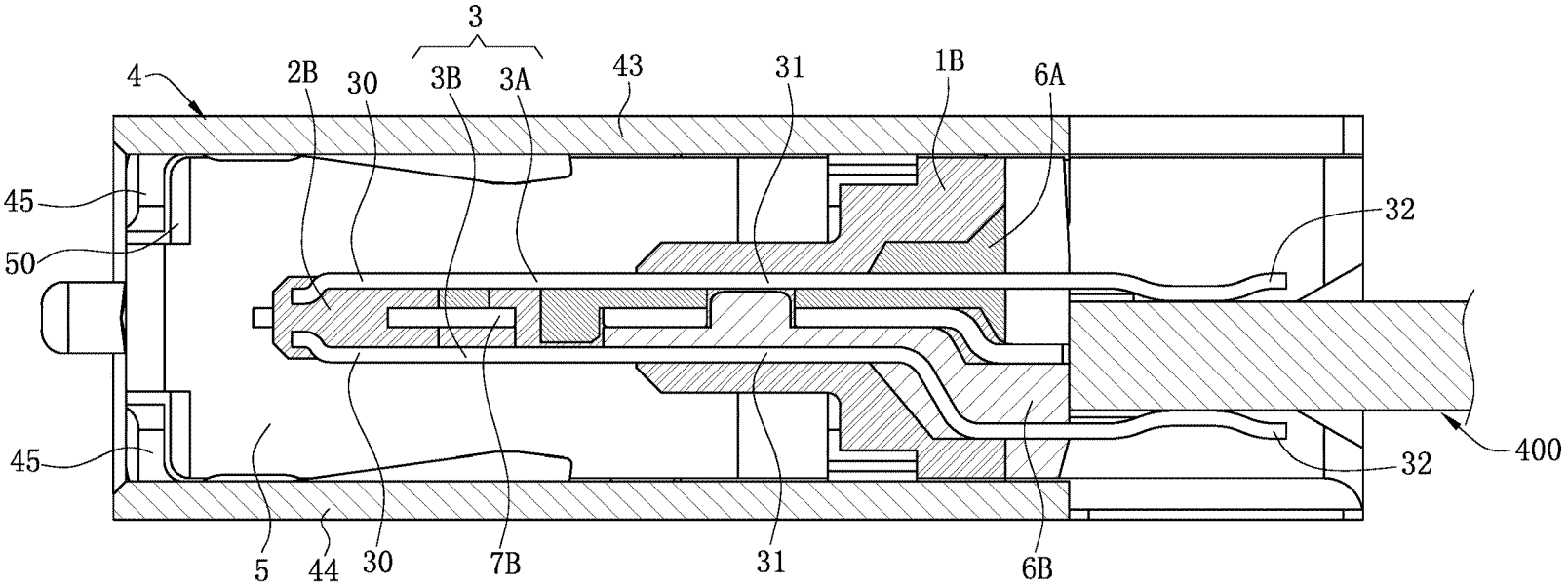
FIG. 7 is a sectional view of the composite connector in FIG. 4 assembled on a circuit board along a line B-B.

As shown in FIG. 1, FIG. 2 and FIG. 6, the rear end of the upper insulator 6A extends backwards to form a clamping portion 60A, and the rear end of the lower insulator 6B extends backwards to form a clamping portion 60B. A fixing space 61 is formed backwards therethrough between the two clamping portions 60A and 60B. The fixing space 61 is configured to clamp a circuit board 400 (as shown in FIG. 7) therein, and a height of the rear end of the fixing space 61 is smaller than a height of the front end thereof, so that the dimensional tolerance of the circuit board 400 can be absorbed, and smooth insertion of the circuit board 400 into the fixing space 61 is facilitated. The clamping portions 60A and 60B and the fool-proof member 5 are aligned in a front-rear direction, and widths of the clamping portions 60A and 60B are greater than a width of the fool-proof member 5, so that the clamping portions 60A and 60B can be fixed stably and reliably. In other embodiments, the clamping portions 60A and 60B can be also formed by integrally extending backwards from the first insulating body 1A and the second insulating body 1B. A through hole is formed at the rear end of the clamping portion 60A of the upper insulator 6A, and a protruding column correspondingly fixed in the through hole is arranged in an upward protruding manner at the rear end of the clamping portion 60B of the lower insulator 6B.

As shown in FIG. 1 to FIG. 3, each terminal 3 of the terminals 3A in the upper row has a contact portion 30 exposed from the upper surface of the first tongue plate 2A or the second tongue plate 2B. A connecting portion 31 extending backwards from the contact portion 30 is at least partially fixed in the first insulating body 1A or the second insulating body 1B. The connecting portion 31 continues extending backwards to form a soldering portion 32 soldered on the upper surface of the circuit board 400 by surface soldering. Similarly, each terminal 3 of the terminals 3B in the lower row has provided with a contact portion 30 exposed from the lower surface of the first tongue plate 2A or the second tongue plate 2B. A connecting portion 31 extending backwards from the contact portion 30 is at least partially fixed in the first insulating body 1A or the second insulating body 1B. The connecting portion 31 continues extending backwards to form a soldering portion 32 soldered on the lower surface of the circuit board 400 by surface soldering. The soldering portions 32 of the terminals 3A in the upper row and the soldering portions 32 of the terminals 3B in the lower row form splint-type soldering.

The first shielding sheet 7A and the second shielding sheet 7B are fixed in the first tongue plate 2A and the second tongue plate 2B respectively. The first shielding sheet 7A and the second shielding sheet 7B are positioned between the terminals 3A and 3B in the upper and lower rows of respectively. For forming convenience and assembling process simplification, the first shielding sheet 7A and the second shielding sheet 7B are integrally formed, and a reinforcing plate 7C is integrally formed between the first shielding sheet 7A and the second shielding sheet 7B and positioned in the fool-proof member 5, the first tongue plate 2A and the second tongue plate 2B. In the embodiment, the first shielding sheet 7A, the second shielding sheet 7B and the reinforcing plate 7C are correspondingly embedded in the first tongue plate 2A, the second tongue plate 2B and the fool-proof member 5 respectively, thus ensuring the position accuracy of the first shielding sheet 7A, the second shielding sheet 7B and the reinforcing plate 7C.

Fastening slots 70 are formed at the two sides of the first shielding sheet 7A and the second shielding sheet 7B respectively, and are exposed from the two sides of the first tongue plate 2A and the second tongue plate 2B. The first tongue plate 2A and the second tongue plate 2B are provided with grooves 20 corresponding to the fastening slots 70, and the fastening slots 70 and the grooves 20 are at least partially laterally flush. The fastening slots 70 and the grooves 20 are buckled with latch members (not shown in the figures) of the docking connectors to ensure firm docking with the docking connectors. Hollow slots 71 are concavely formed at the two sides of the first shielding sheet 7A and the second shielding sheet 7B close to the rear ends of the fastening slots 70 respectively. Strip connecting portions 72 are respectively provided on at least one side of the first shielding sheet 7A and the second shielding sheet 7B close to the rear ends of the hollow slots 71, and the strip connecting portions 72 are respectively exposed from the two lateral surfaces of the first insulating body 1A and the second insulating body 1B, so that the strip connecting portions 72 facilitate positioning of the first shielding sheet 7A and the second shielding sheet 7B during forming and ensure forming accuracy. A grounding portion 73 is arranged on the side of each of the first shielding sheet 7A and the second shielding sheet 7B close to the rear end and far away from the reinforcing plate 7C, and the grounding portion 73 protrudes and extends from the first insulating body 1A and the second insulating body 1B to contact with the inner wall of the metal shell 4 to enhance grounding effects of the first shielding sheet 7A and the second shielding sheet 7B, and to facilitate improvement in crosstalk interference and the like during signal transmission of the terminals 3A and 3B in the upper and lower rows. Further, a soldering pin 74 extends backwards from the rear end of each of the first shielding sheet 7A and the second shielding sheet 7B, configured to solder to the circuit board 400.

As shown in FIG. 2 and FIG. 3, the reinforcing plate 7C is embedded in the fool-proof member 5, thereby strengthening the fool-proof member 5. Further, the two sides of the reinforcing plate 7C are exposed from the two lateral surfaces 51 of the fool-proof member 5, so that the first insertion opening 41 is formed by the metal shell 4 and one side of the reinforcing plate 7C, and the second insertion opening 42 is formed by the metal shell 4 and the other side of the reinforcing plate 7C. The insertion openings are formed by fully utilizing the structure of the reinforcing plate 7C, thus saving the space and materials, and further preventing the fool-proof member 5 from being excessively scraped and abraded during insertion of the docking connectors. The reinforcing plate 7C can be flush with the lateral surfaces 51, or can be slightly projective from the lateral surfaces 51. In the embodiment, each lateral surface 51 has a middle section 5*b* which is concaved inwards, as well as a front section 5*a* and a rear section 5*c*, which are respectively positioned in front of and behind the middle section 5*c*. Each side of the reinforcing plate 7C projects from the middle section 5*b*, and is also flush with the front section 5*a* and the rear section 5*c* of the corresponding lateral surface 51.

As shown in FIG. 3, FIG. 4 and FIG. 5, the metal shell 4 is provided with a top wall 43 and a bottom wall 44. Two wrapping portions 45 are formed corresponding to the two reserved slots 50 at the front end of the fool-proof member 5 by bending and extending from the top wall 43 and the bottom wall 44 respectively, and the two wrapping portions 45 are fixed in the two reserved slots 50 respectively, thus conveniently matching and fixing the metal shell 4 with the fool-proof member 5, and strengthening the fool-proof member 5 to avoid shaking of the fool-proof member 5 during insertion of the docking connectors. The two wrapping portions 45 bend and extend respectively downwards and upwards from edges of the top wall 43 and the bottom wall 44, and the width of each of the wrapping portions 45 is smaller than the width of the fool-proof member 5, thus preventing the docking connectors from scratch by the lateral surfaces of the wrapping portions 45 during insertion.

In certain embodiments, the composite connector of the present invention has the following beneficial effects.

1. Since the first shielding sheet 7A and the second shielding sheet 7B are integrally formed, and the first insulating body 1A, the second insulating body 1B and the fool-proof member 5 are integrally formed, the forming process can be simplified, and subsequent assembling can be facilitated.

2. Since the reinforcing plate 7C is integrally formed between the first shielding sheet 7A and the second shielding sheet 7B and positioned in the fool-proof member 5, the fool-proof member 5 can be strengthened. The first shielding sheet 7A, the second shielding sheet 7B and the reinforcing plate 7C are correspondingly embedded in the first tongue plate 2A, the second tongue plate 2B and the fool-proof member 5 respectively, thus ensuring the position accuracy of the first shielding sheet 7A, the second shielding sheet 7B and the reinforcing plate 7C.

3. Since the two sides of the reinforcing plate 7C are exposed from and flush with the two lateral surfaces 51 of the fool-proof member 5, the first insertion opening 41 is formed by the metal shell 4 and one side of the reinforcing plate 7C, and the second insertion opening 42 is formed by the metal shell 4 and the other side of the reinforcing plate 7C. The insertion openings are formed by fully utilizing the structure of the reinforcing plate 7C, thus saving the space and materials, and further preventing the fool-proof member 5 from being excessively scraped and abraded during insertion of the docking connectors.

4. The fool-proof member 5 extends forward beyond the first tongue plate 2A and the second tongue plate 2B, thus enabling the docking connectors to be guided for insertion, and preventing the first tongue plate 2A, the second tongue plate 2B and the terminals 3 positioned on the first tongue plate 2A and the second tongue plate 2B from being damaged by inserting the docking connectors.

5. The fool-proof member 5 abuts against an inner wall of the metal shell 4 upwards and downwards in a vertical direction respectively, so that the first insertion opening 41 is formed by the metal shell 4 and one lateral surface 51 of the fool-proof member 5, and the second insertion opening 42 is formed by the metal shell 4 and the other lateral surface of the fool-proof member 5. Thus, the insertion openings are formed by fully utilizing the structure of the fool-proof member 5, and the space and materials can be saved.

6. The clamping portions 60A and 60B form the fixing space 61 which is backwards therethrough, and the fixing space 61 is configured to clamp the circuit board 400 therein. The height of the rear end of the fixing space 61 is smaller than the height of the front end thereof, so that the dimensional tolerance of the circuit board 400 can be absorbed, and smooth insertion of the circuit board 400 into the fixing space 61 is facilitated. The clamping portions 60A and 60B and the fool-proof member 5 are aligned in a front-rear direction, and the widths of the clamping portions 60A and 60B are greater than the width of the fool-proof member 5, so that the clamping and fixing portions 60A and 60B can be fixed stably and reliably.

7. The two wrapping portions 45 on the metal shell 4 are fixed in the two reserved slots 50 of the fool-proof member 5 respectively, thus conveniently matching and fixing the metal shell 4 with the fool-proof member 5, and strengthening the fool-proof member 5 to avoid shaking of the fool-proof member 5 during insertion of the docking connectors. The two wrapping portions 45 bend and extend respectively downwards and upwards from edges of the top wall 43 and the bottom wall 44, and the width of each of the wrapping portions 45 is smaller than the width of the fool-proof member 5, thus preventing the docking connectors from scratch by the lateral surfaces of the wrapping portions 45 during insertion.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A composite connector, comprising:

a first insulating body and a second insulating body arranged side by side, wherein a first tongue plate and a second tongue plate are arranged at front ends of the first insulating body and the second insulating body respectively, a fool-proof member is arranged between the first insulating body and the second insulating body, and gaps are formed between the fool-proof member and the first tongue plate and between the fool-proof member and the second tongue plate;

a plurality of terminals, respectively fixedly arranged on the first insulating body and the second insulating body and exposed from surfaces of the first tongue plate and the second tongue plate; and a first shielding sheet and a second shielding sheet, fixedly arranged in the first tongue plate and the second tongue plate respectively, and are positioned on one side of the terminals, wherein the first shielding sheet and the second shielding sheet are integrally formed, and a reinforcing plate is integrally formed between the first shielding sheet and the second shielding sheet and positioned in the fool-proof member.

2. The composite connector according to claim 1, wherein two sides of the reinforcing plate are exposed from two lateral surfaces of the fool-proof member respectively.

3. The composite connector according to claim 2, wherein each of the two lateral surfaces has a middle section concaved inwards, and a front section and a rear section respectively positioned in front of and behind the middle section, and each of the two sides of the reinforcing plate projects from the middle section and is flush with the front section and the rear section of the corresponding lateral surface.

4. The composite connector according to claim 1, wherein the first insulating body, the second insulating body and the fool-proof member are integrally formed.

5. The composite connector according to claim 1, wherein the fool-proof member extends forward beyond the first tongue plate and the second tongue plate.

6. The composite connector according to claim 1, wherein the first shielding sheet and the second shielding sheet are embedded in the first tongue plate and the second tongue plate.

7. The composite connector according to claim 1, wherein the terminals are arranged on upper surfaces and lower surfaces of the first tongue plate and the second tongue plate respectively, the number of the terminals on the first tongue plate is unequal to the number of the terminals on the second tongue plate, the first shielding sheet and the second shielding sheet are positioned between the terminals in an upper row and a lower row respectively, and the terminals in each row are arranged in a central symmetry.

8. The composite connector according to claim 1, wherein fastening slots are formed at the two sides of the first shielding sheet and the second shielding sheet respectively, and are exposed from the first tongue plate and the second tongue plate.

9. The composite connector according to claim 8, wherein the first tongue plate and the second tongue plate are provided with grooves corresponding to the fastening slots, and the fastening slots and the grooves are at least partially laterally flush.

10. The composite connector according to claim 8, wherein hollow slots are concavely formed at the two sides of the first shielding sheet and the second shielding sheet close to rear ends of the fastening slots respectively.

11. The composite connector according to claim 10, wherein a plurality of strip connecting portions is respectively provided on at least one of the two sides of the first shielding sheet and the second shielding sheet close to rear ends of the hollow slots, and the strip connecting portions are respectively exposed from the two lateral surfaces of the first insulating body and the second insulating body.

12. The composite connector according to claim 1, further comprising a metal shell, wherein the metal shell forms a first insertion opening and a second insertion opening around the first tongue plate and the second tongue plate respectively, the first insertion opening is configured for insertion of a first docking connector, the second insertion opening is configured for insertion of a second docking connector, and a combination of the first insertion opening and the second insertion opening is configured for insertion of a third docking connector.

13. The composite connector according to claim 12, wherein the fool-proof member abuts against an inner wall of the metal shell upwards and downwards in a vertical direction respectively, the first insertion opening is formed by the metal shell and one of the two lateral surfaces of the fool-proof member, and the second insertion opening is formed by the metal shell and the other of the two lateral surfaces of the fool-proof member.

14. The composite connector according to claim 12, wherein a grounding portion is arranged on the side of each of the first shielding sheet and the second shielding sheet close to a rear end and away from the reinforcing plate, and the grounding portion protrudes and extends to contact with the inner wall of the metal shell.

15. The composite connector according to claim 1, wherein a clamping portion is arranged at a rear end of the first insulating body and the second insulating body, the clamping portion forms a fixing space configured to clamp a circuit board therein, and a height of a rear end of the fixing space is lower than a height of a front end of the fixing space.

16. The composite connector according to claim 15, wherein the clamping portion is aligned to the fool-proof member in a front-rear direction, and a width of the clamping portion is greater than a width of the fool-proof member.

17. The composite connector according to claim 1, further comprising a metal shell around the first tongue plate and the second tongue plate, wherein the metal shell has a top wall and a bottom wall, two wrapping portions are formed corresponding to two reserved slots at a front end of the fool-proof member by bending and extending from the top wall and the bottom wall respectively, and the two wrapping portions are fixed in the two reserved slots respectively.

18. The composite connector according to claim 17, wherein the two wrapping portions bend and extend respectively downwards and upwards from edges of the top wall and the bottom wall, and a width of each of the wrapping portions is smaller than a width of the fool-proof member.

19. A composite connector, comprising: a first insulating body and a second insulating body, wherein a first tongue plate and a second tongue plate are arranged at front ends of the first insulating body and the second insulating body respectively; a plurality of terminals, respectively fixed on the first insulating body and the second insulating body and exposed from surfaces of the first tongue plate and the second tongue plate; a first shielding sheet and a second shielding sheet, fixed in the first tongue plate and the second tongue plate respectively, and are positioned on one side of the terminals, wherein the first shielding sheet and the second shielding sheet are integrally formed; and a metal shell, forming a first insertion opening and a second insertion opening around the first tongue plate and the second tongue plate respectively, wherein the first insertion opening is configured for insertion of a first docking connector, the second insertion opening is configured for insertion of a second docking connector, and a combination of the first insertion opening and the second insertion opening is configured for insertion of a third docking connector; wherein a fool-proof member is integrally formed between the first insulating body and the second insulating body, gaps are formed between the fool-proof member and the first tongue plate and between the fool-proof member and the second tongue plate, and a reinforcing plate is integrally formed between the first shielding sheet and the second shielding sheet and positioned in the fool-proof member.

20. The composite connector according to claim 19, wherein two sides of the reinforcing plate are respectively exposed from two lateral surfaces of the fool-proof member, the first insertion opening is formed by the metal shell and one of the two sides of the reinforcing plate, and the second insertion opening is formed by the metal shell and the other of the two sides of the reinforcing plate.

21. The composite connector according to claim 19, wherein fastening slots are formed at the two sides of the first shielding sheet and the second shielding sheet respectively, the first tongue plate and the second tongue plate are provided with grooves corresponding to the fastening slots, the fastening slots are exposed from the grooves, and the fastening slots and the grooves are at least partially laterally flush.

22. The composite connector according to claim 19, wherein the terminals are arranged on upper surfaces and lower surfaces of the first tongue plate and the second tongue plate respectively, the number of the terminals on the first tongue plate is unequal to the number of the terminals on the second tongue plate, the first shielding sheet and the second shielding sheet are positioned between the terminals in an upper row and a lower row respectively, and the terminals in each row are arranged in a central symmetry.

* * * * *